US009686614B2

(12) United States Patent
Meng et al.

(10) Patent No.: US 9,686,614 B2
(45) Date of Patent: Jun. 20, 2017

(54) ELECTRO-ACOUSTIC DEVICE

(71) Applicants: Yiming Meng, Shenzhen (CN); Wei Pang, Shenzhen (CN); Yunxia Xu, Shenzhen (CN); Xiaojiang Gu, Shenzhen (CN)

(72) Inventors: Yiming Meng, Shenzhen (CN); Wei Pang, Shenzhen (CN); Yunxia Xu, Shenzhen (CN); Xiaojiang Gu, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/004,978

(22) Filed: Jan. 24, 2016

(65) Prior Publication Data

US 2016/0366509 A1 Dec. 15, 2016

(51) Int. Cl.

| | |
|---|---|
| ***H04R 9/02*** | (2006.01) |
| ***H04R 1/28*** | (2006.01) |
| ***H04R 1/02*** | (2006.01) |

(52) U.S. Cl.

CPC ..... *H04R 9/025* (2013.01); *H04R 1/023* (2013.01); *H04R 1/288* (2013.01); *H04R 2209/024* (2013.01); *H04R 2499/11* (2013.01)

(58) Field of Classification Search

CPC ..... H04R 1/023; H04R 1/025; H04R 1/086; H04R 1/2823; H04R 1/2826; H04R 1/2876; H04R 1/288; H04R 9/025; H04R 9/027; H04R 9/06; H04R 9/08; H04R 9/047; H04R 2209/024; H04R 2209/027; H04R 2499/11; H04R 2499/15

See application file for complete search history.

(56) References Cited

U.S. PATENT DOCUMENTS

| | | | | |
|---|---|---|---|---|
| 2007/0274557 | A1* | 11/2007 | Chiba | H01R 13/2442 381/412 |
| 2009/0154753 | A1* | 6/2009 | Akino | H04R 9/08 381/355 |
| 2013/0016874 | A1* | 1/2013 | Huang | H04R 9/043 381/433 |
| 2014/0119591 | A1* | 5/2014 | Meng | H04R 9/02 381/386 |

* cited by examiner

*Primary Examiner* — Joshua Kaufman
(74) *Attorney, Agent, or Firm* — Na Xu; IPro, PLLC

(57) ABSTRACT

An electro-acoustic device is provided, including a frame; a magnetic circuit received in the frame and including a lower plate fixed on a bottom of the frame and a magnet attached on the lower plate; a vibration system received in the frame and including a vibrating diaphragm attached to a top of the frame; a cavity formed cooperatively by the lower plate, the frame and the vibrating diaphragm; a leak hole provided between the frame and the lower plate for communicating with outside of the electro-acoustic device; and a damper attached to the lower plate and located inside of the electro-acoustic device for covering the leak hole internally.

6 Claims, 5 Drawing Sheets

ELECTRO-ACOUSTIC DEVICE

FIELD OF THE INVENTION

The present disclosure relates to electro-acoustic devices, more particularly to a miniature sound generator.

DESCRIPTION OF RELATED ART

With the development of technology and society, electronic products are much popular now and the magnetic circuit systems are used widely thereby. In order to have a better audible enjoyment, the people have increasingly higher requirements on the performance of the electro-acoustic devices.

The electro-acoustic device with related technology includes usually a frame, and a magnetic circuit and a vibration system which are installed in the frame. The vibration system includes usually a vibrating diaphragm which is fixed on the frame. When the vibrating diaphragm vibrates, the air inside the cavity of the electro-acoustic device is compressed. The electro-acoustic device is provided usually with a leak hole and the leak hole outside is covered by a damper for dust proof and increasing acoustic resistance. However, the leak hole can be blocked up easily and the acoustic performance is affected thereby in such a structure when the exterior space is small.

Therefore, it is necessary to provide a new electro-acoustic device to overcome the problems mentioned above.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment. To make the technical problems to be solved, technical solutions and beneficial effects of present disclosure more apparent, the present disclosure is described in further detail together with the figures and the embodiment. It should be understood the specific embodiment described hereby is only to explain this disclosure, not intended to limit this disclosure.

Figure 1:
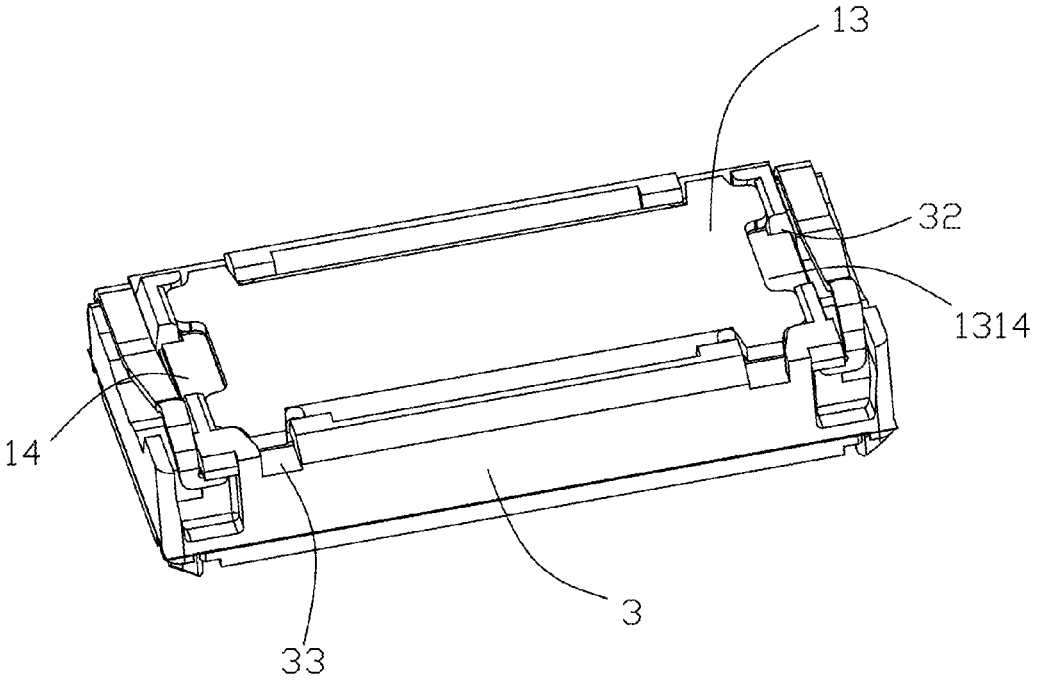
FIG. 1 is an isometric view of an electro-acoustic device in accordance with an exemplary embodiment of the present disclosure.
Figure 2:
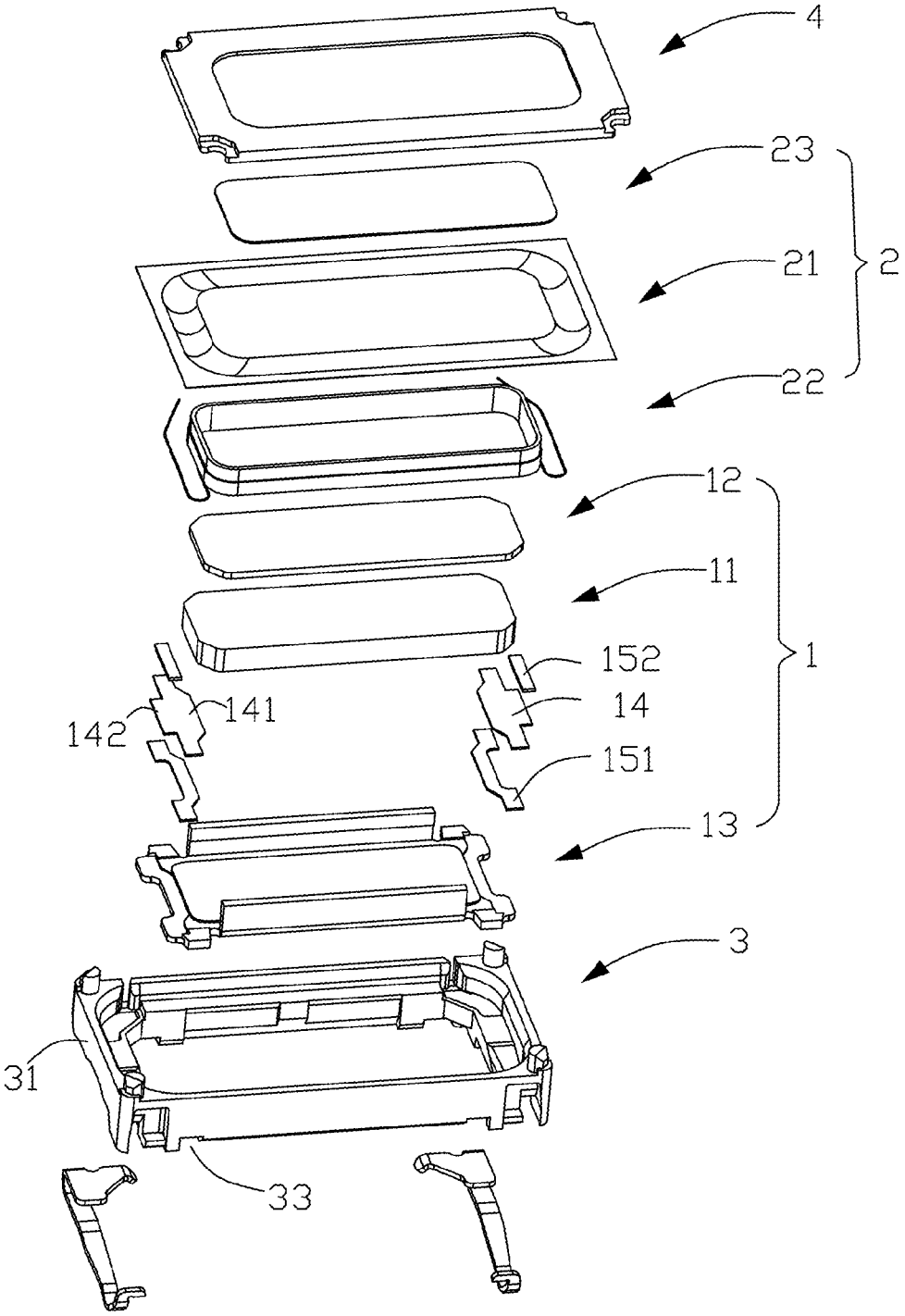
FIG. 2 is an exploded view of the electro-acoustic device in FIG. 1.

As shown in FIGS. 1 and 2, an electro-acoustic device in accordance with an exemplary embodiment of the present disclosure includes a frame 3, a magnetic circuit 1 and a vibration system 2 received in the frame 3.

As shown in FIG. 2, the vibration system 2 includes a vibrating diaphragm 21 and a voice coil 22 for driving the vibrating diaphragm 21 on the frame 3. Further, the vibration system 2 includes a vibrating plate 23 attached on the vibrating diaphragm 21 to intensify the vibration of the vibrating diaphragm 21. In this embodiment, a front cover 4 is installed on the frame 3 and attached to a peripheral of the vibrating diaphragm 21 for protecting the diaphragm.

The magnetic circuit system 1 includes a lower plate 13 which is fixed on the bottom of the frame. The lower plate 13, the frame 3 and the vibrating diaphragm 21 form cooperatively a cavity of the electro-acoustic device. The magnetic circuit 1 includes a magnet 11 which is fixed on the lower plate 13 and a pole piece 12 attached on the magnet 11. At least one of the magnet 11 and the pole piece 12 is a permanent magnet. In this embodiment, the magnet 11 is a permanent magnet and the pole piece 12 is a magnetic conductive part. Certainly, both parts can be permanent magnets in other embodiments.

The frame 3 is an open frame formed by side walls 31. The vibrating diaphragm 21 is attached on the top of the frame side wall 31. The lower plate 13 is fixed on the bottom of the frame 3. The lower plate 13, vibrating diaphragm 21 and frame 3 create together the cavity of the electro-acoustic device. A magnetic gap between the side plate 132 and the magnet 11 is formed accordingly. The voice coil 22 is partially inserted into the magnetic gap to cut magnetic induction lines and vibrate the vibrating diaphragm 21. The lower plate 13 includes a bottom plate 131 covering the bottom hole of the frame 3 and side plate 132 extending toward the vibrating diaphragm 21 from both major axis edges of the bottom plate 131. The side plate 132 is attached on the inner wall of the frame 3. The bottom plate 131 includes a bottom plate main part 1310 and a step part 1311 protruded toward the vibrating diaphragm 21 from the center of the bottom plate main part. The magnet 11 is placed on the step part 1311. In this embodiment, single magnetic circuit structure is adopted, i.e. there is only one magnet 11. The structure of multiple magnetic circuits can be adopted also in other embodiments, i.e. there are several magnets. The lower plate 13 can be made of magnetic material, and can also be made of non-magnetic material. The magnetic material is optimal.

Figure 3:
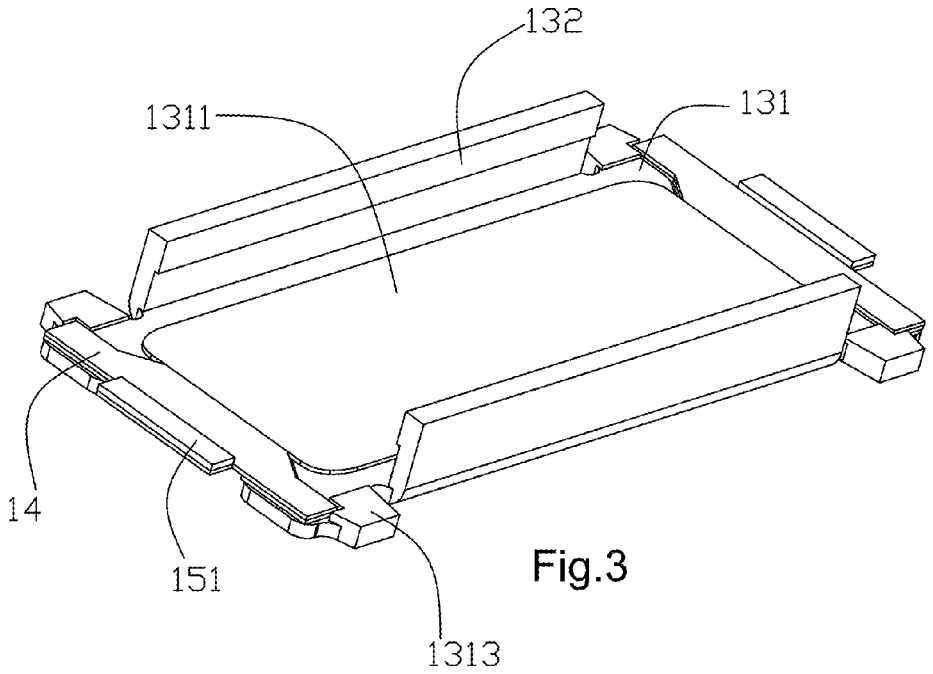
FIG. 3 is an isometric view of an assembly of a lower plate and a damper of the electro-acoustic device.
Figure 4:
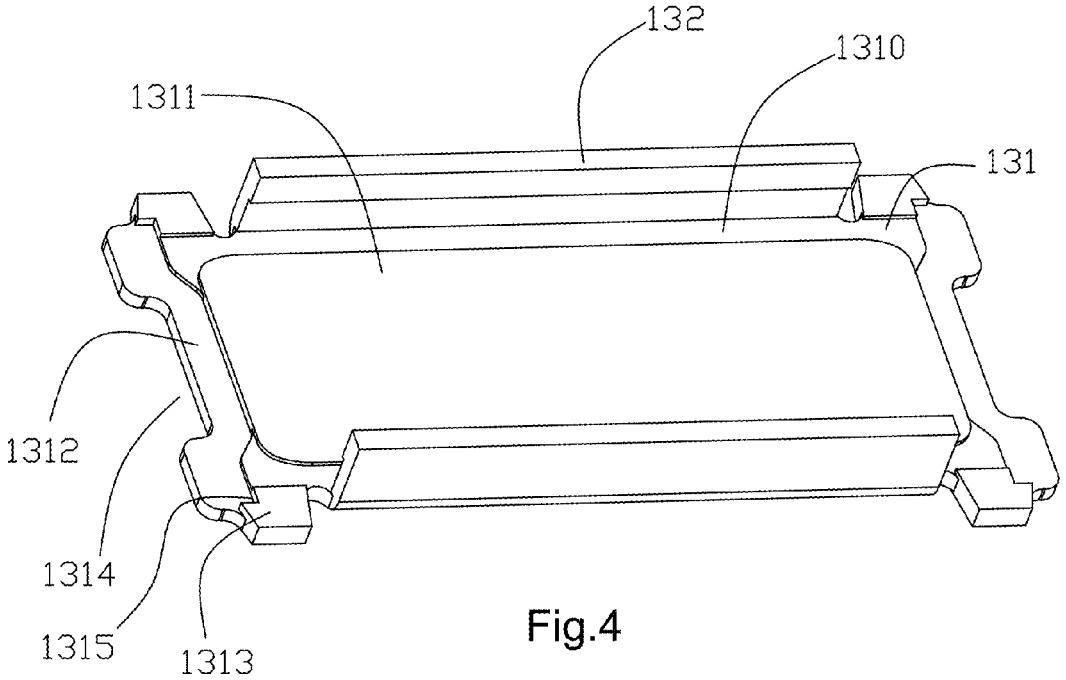
FIG. 4 is an isometric view of the lower plate of the electro-acoustic device.
Figure 5:
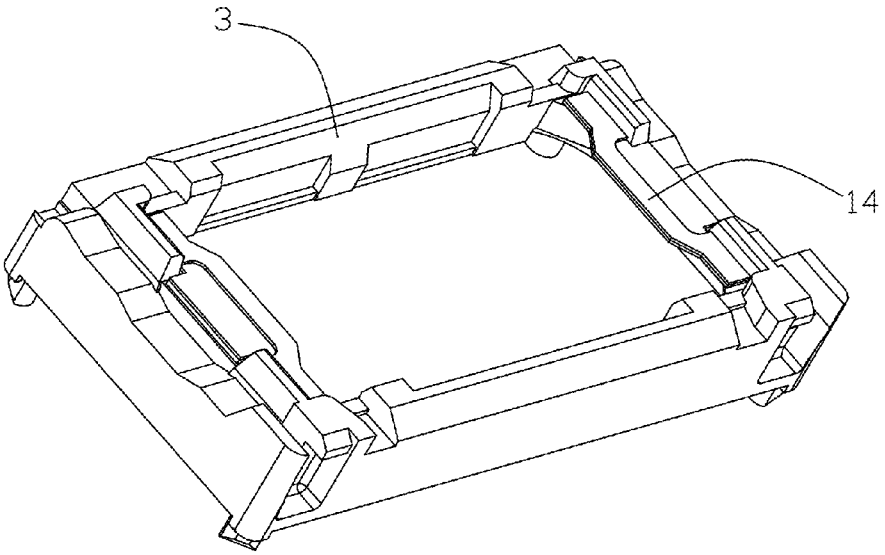
FIG. 5 is an isometric view of an assembly of a frame and a damper of the electro-acoustic device.

As shown in FIGS. 3-5, two edges of the bottom plate 131 are extended toward two side plates 132 externally along the minor axis to form a fixing part 1313. The fixing part is projected from the plane of the lower plate side wall 132 in the side direction of the lower plate 13. The fixing part 1313 is fixed on the bottom of the frame side wall 31. The fixing part 1313 is projected in horizontal direction from the plane of the bottom plate main part. Preferably, the fixing part 1313 is projected in horizontal direction from the plane of the step 1311. The bottom of the frame side wall 31 has a slot 33 to fix the fixing part 1313. The slot 33 and the fixing part 1313 locate and fix together the frame 3 and the lower plate 13.

Figure 6:
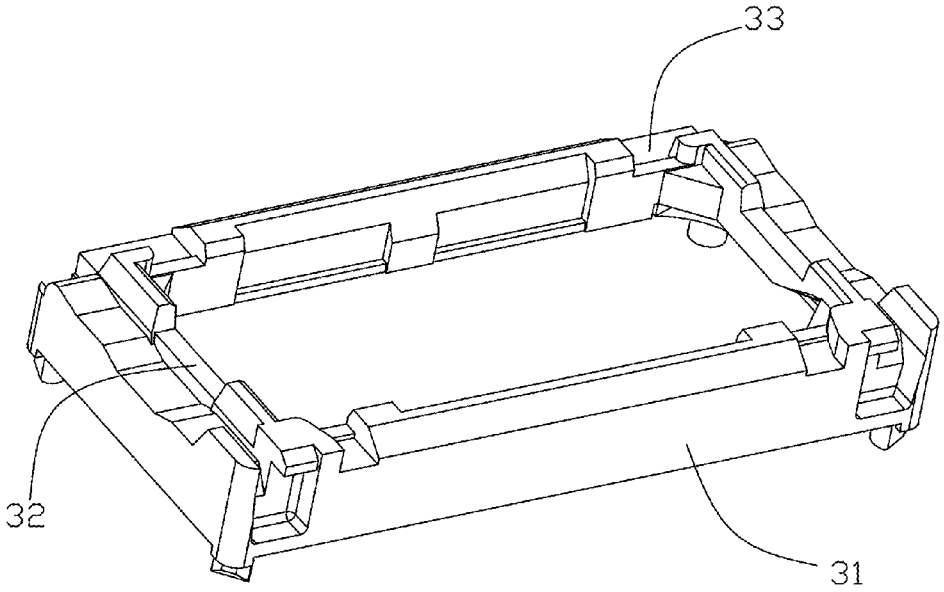
FIG. 6 is an isometric view of the frame of the electro-acoustic device.
Figure 7:
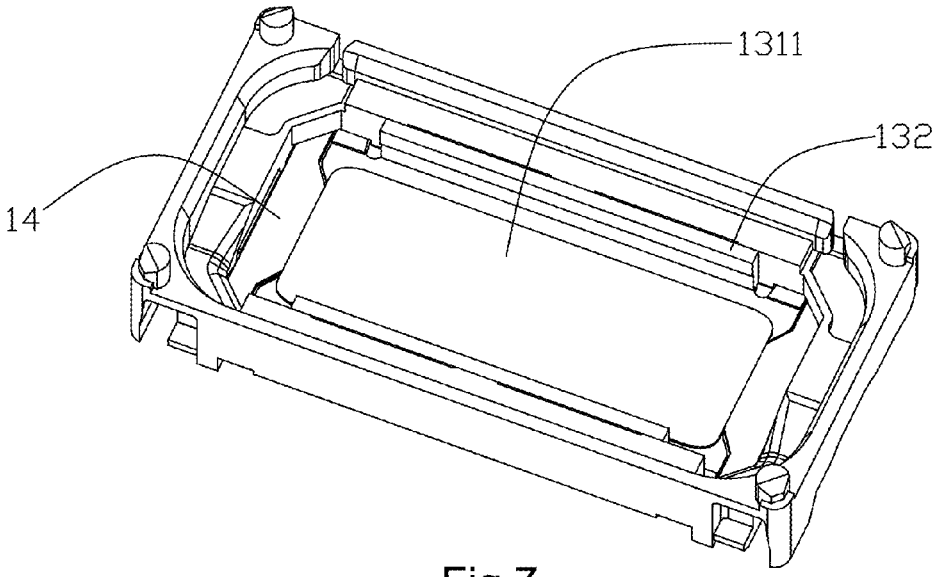
FIG. 7 is an isometric view of an assembly of the frame and the damper of the electro-acoustic device, from another aspect.

As shown in FIGS. 5-7, the bottom plate 131 is provided with a first notch 1314 which is located at the center of minor axis edge and extended from the frame side wall 31. The side wall 31 of the frame 3 is provided with a second notch 32 corresponding to the first notch 1314. The bottom plate 131 is attached on the frame 3. The projection of the second notch 32 in the direction of the bottom plate 131 falls on the first notch 1314. The first notch 1314 and the second notch 32 form cooperatively a leak hole to communicate the cavity of the electro-acoustic device with ambient air. The air in the cavity can be discharged through the leak hole so as to improve the acoustic performance of the product. The ambient air is the air in the space of the electro-acoustic device, usually in the internal space of the mobile communication equipment provided with the electro-acoustic device according to the installation site. In another case, the ambient air can also be the air from the exterior space of the mobile communication equipment provided with the electro-acoustic device.

The first notch 1314 passes through the bottom plate 132 of the lower plate. The cavity of the electro-acoustic device is communicated with the ambient air outside the bottom of the electro-acoustic device through the first notch 1314. The second notch 32 passes through the side wall 31 of the frame. The electro-acoustic device is communicated through the second notch 32 to the ambient air outside the side of the electro-acoustic device. In this way, even the installation space is limited, when the bottom of the electro-acoustic device is clogged, the air can leak out from the second notch on the side wall. Similarly, when the side wall is clogged, the air can also leak out from the first notch 1314 on the bottom.

A damper 14 is located between the bottom plate 131 of the lower plate 13 and the bottom of the side wall 31 of the frame. The damper 14 covers the leak hole internally from the electro-acoustic device. Specifically, the upper surface of the damper 14 is connected to the frame 3. The lower surface of the damper is connected to the lower plate 13. Two minor axis edges of the bottom plate 132 are provided with a pit 1312 which surrounds the first notch 1314 and is recessed from the bottom plate main part to the bottom of the bottom plate for fixing the damper 14. The damper 14 is installed inside the pit 1312. The damper 14 is divided into two parts: the first part 141 is attached in the pit 1312 and the second part 142 which is connected to the first part 141 and covers the leak hole. The upper surface of the second part 142 is connected to the bottom of the frame 3. As shown in FIGS. 6 and 7, FIG. 6 is the combination diagram of the frame and the damper exposed from the bottom direction of the electro-acoustic device. FIG. 7 is the combination diagram of the frame and the damper exposed from the top direction of the electro-acoustic device.

The pit 1312 can locate the damper 14 and reduce overall height. Optionally, the fixing part 1313 is provided also with a locating slot 1315 to fix the edge of the damper 14. The damper 14 can be fixed accurately and firmly so the product reliability is improved.

A first layer of rubber 151 is provided between the first part 141 and the pit 1312. The shape of the first layer of rubber is consistent with the shape of the pit 1312. A second layer of rubber 152 is provided between the upper surface of the second part and the lower surface of the side wall 31 of the frame. The damper 14 is fixed on the frame 3 and the lower plate 13 through the rubber layers.

The damper 14 blocks the gap between the frame 3 and the lower plate 13 for dustproof. In addition, when the vibrating diaphragm 21 vibrates, the air in the cavity is compressed. The damper 14 has a certain degree of buffer action to the compressed air, so it can improve the acoustic resistance of the products, thereby increase the acoustic performance.

In this embodiment, both the frame 3 and the bottom plate 131 are long strips, certainly, they can be made in other shapes. The major axis, minor axis, major axis edge, minor axis edge described above are used only for indicating conveniently the direction and do not necessarily mean their length, nor the shape.

In the electro-acoustic device of the present disclosure, the lower plate is located on the bottom of the frame. A leak hole is created between the lower plate and the frame. The lower plate is attached with a damper. The damper covers the hole internally from the electro-acoustic device. The electro-acoustic device in the utility model can play the role of dustproof, reduce wind resistance and improve the acoustic properties.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electro-acoustic device, comprising:

a frame;

a magnetic circuit received in the frame and including a lower plate fixed on a bottom of the frame and a magnet attached on the lower plate, the lower plate having a bottom plate and a side plate extending toward the vibrating diaphragm on both sides of the bottom plate, the side plate attached to an inner wall of the frame, each of the sides of the bottom plate provided with a first notch located at the center of both sides of the bottom plate;

a vibration system received in the frame and including a vibrating diaphragm attached to a top of the frame;

a cavity formed cooperatively by the lower plate, the frame and the vibrating diaphragm;

a side wall of the frame provided with a second notch corresponding to the first notch for forming a leaking hole cooperatively, the leaking hole provided between the frame and the lower plate for communicating with outside of the electro-acoustic device;

a pit located at two ends of the bottom plate and surrounding the first notch;

a damper installed inside the pit of the lower plate and covering the leaking hole internally;

the damper having a first part having a lower surface attached to the pit and a second part covering the leaking hole, and an upper surface of the second part attaches to the bottom of the frame.

2. The electro-acoustic device as described in claim 1, wherein the bottom plate includes a fixing part extending toward the side plate and fixed with the bottom of the frame.

3. The electro-acoustic device as described in claim 2, wherein the sidewall of the frame includes a slot for fixing the fixing part.

4. The electro-acoustic device as described in claim 2, wherein the fixing part is provided with a locating slot for fixing an edge of the damper.

5. The electro-acoustic device as described in claim 4, wherein the fixing part projects outwardly in horizontal direction from a plane where the bottom plate is located.

6. The electro-acoustic device as described in claim 5 further including a first layer of a rubber located between the first part of the damper and the pit, and a second layer of the rubber located between the second part of the damper and the frame, the shape of the first layer of the rubber being consistent with the shape of the pit.

* * * * *